US007695086B2

(12) United States Patent
Iwao et al.

(10) Patent No.: US 7,695,086 B2
(45) Date of Patent: Apr. 13, 2010

(54) INK JET PRINTER APPLYING DIFFERENT VOLTAGE PULSES IN ACTUATOR

(75) Inventors: Naoto Iwao, Nagoya (JP); Atsuo Sakaida, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 236 days.

(21) Appl. No.: 11/752,150

(22) Filed: May 22, 2007

(65) Prior Publication Data

US 2007/0291057 A1 Dec. 20, 2007

(30) Foreign Application Priority Data

May 23, 2006 (JP) ..... 2006-142293

(51) Int. Cl.
*B41J 29/38* (2006.01)
*B41J 2/45* (2006.01)

(52) U.S. Cl. ..... 347/11; 347/71

(58) Field of Classification Search ..... 347/11
See application file for complete search history.

(56) References Cited

U.S. PATENT DOCUMENTS 4,350,989 A * 9/1982 Sagae et al. ..... 347/68
4,398,204 A * 8/1983 Dietrich et al. ..... 347/68
4,639,735 A * 1/1987 Yamamoto et al. ..... 347/68
6,109,715 A 8/2000 Masaki
6,231,151 B1 * 5/2001 Hotomi et al. ..... 347/11
6,331,052 B1 * 12/2001 Murai et al. ..... 347/68
6,354,685 B1 * 3/2002 Ohashi ..... 347/11
6,431,674 B2 * 8/2002 Suzuki et al. ..... 347/11
2006/0209108 A1 * 9/2006 Hamazaki et al. ..... 347/11

(Continued)

FOREIGN PATENT DOCUMENTS

EP 0788882 A2 8/1997

(Continued)

OTHER PUBLICATIONS

European Patent Office, European Search Report (European Patent Appl'n No. 07010239.7-1251 (counterpart to above-captioned U.S. patent application) dated Aug. 24, 2007.

(Continued)

*Primary Examiner*—Matthew Luu
*Assistant Examiner*—Shelby Fidler
(74) *Attorney, Agent, or Firm*—Baker Botts L.L.P.

(57) ABSTRACT

An ink jet printer is provided with a passage unit, an actuator, and a pulse applying device. The passage unit comprises a nozzle, a pressure chamber, and an ink passage located between the nozzle and the pressure chamber. The actuator faces the pressure chamber and comprises a first electrode, a second electrode to which a reference potential can be applied, and a piezoelectric element located between the first electrode and the second electrode. The pulse applying device is capable of applying a first voltage pulse to the first electrode such that the nozzle discharges an ink droplet, and a second voltage pulse to the first electrode such that the nozzle does not discharge the ink droplet. A voltage change on a leading edge and/or a trailing edge of the second voltage pulse is greater than a voltage change on a leading edge and/or a trailing edge of the first voltage pulse.

6 Claims, 8 Drawing Sheets

U.S. PATENT DOCUMENTS

2006/0284908 A1* 12/2006 Iwao ..... 347/9
2007/0046704 A1* 3/2007 Okuda ..... 347/11

FOREIGN PATENT DOCUMENTS

JP 2002-036568 A 2/2002
WO 2004096552 A1 11/2004

OTHER PUBLICATIONS

The State Intellectual Property Office of the People's Republic of China, Notification of First Office Action in counterpart Patent Application No. CN 200710104251.4, mailed on Jun. 26, 2009.

* cited by examiner

INK JET PRINTER APPLYING DIFFERENT VOLTAGE PULSES IN ACTUATOR

CROSS-REFERENCE TO RELATED APPLICATION

This application claims priority to Japanese Patent Application No. 2006-142293, filed on May 23, 2006, the contents of which are hereby incorporated by reference into the present application.

BACKGROUND OF THE INVENTION

1. Field of the Invention

The present invention relates to an ink jet printer that performs printing by discharging ink droplets.

2. Description of the Related Art

An ink jet printer is provided with an ink jet head. A normal ink jet head has a passage unit and an actuator. The passage unit comprises a nozzle, a pressure chamber, and an ink passage located between the nozzle and the pressure chamber. The nozzle discharges ink droplets. The actuator applies pressure (discharging energy) to the ink within the pressure chamber by changing the volume of the pressure chamber. A normal actuator comprises a first electrode, a second electrode to which a reference potential is to be applied, and a piezoelectric element located between the first electrode and the second electrode. The actuator faces the pressure chamber. When a pulsating driving voltage is applied to the first electrode, an electrical field operates in the direction of the thickness on the piezoelectric element. The piezoelectric element that is being acted upon by the electrical field expands or contracts. The volume of the pressure chamber thus changes, and pressure (discharging energy) is applied to the ink within the pressure chamber.

Ink discharging characteristics may deteriorate when ink within the nozzle becomes more viscous, and unsatisfactory discharging may occur. In order to avoid this problem, discharge flushing may be performed to discharge the viscous ink from the nozzle.

BRIEF SUMMARY OF THE INVENTION

Ink is consumed when this discharge flushing is performed. In order to avoid this ink consumption, the present inventors considered adopting a technique termed non-discharge flushing wherein an increase in the viscosity of the ink within the nozzle is prevented without ink being consumed. In non-discharge flushing, the actuator is driven such that ink droplets are not discharged from the nozzle, and a pressure wave is generated in the ink within the pressure chamber and the nozzle. The ink is agitated. It is thus possible to prevent the viscosity of the ink from increasing.

The present inventors discovered that the efficiency of non-discharge flushing is improved by increasing the amplitude of the ink pressure wave. The amplitude of the ink pressure wave increases when the energy applied to the ink within the nozzle is increased. The present inventors discovered that it is possible to increase the energy applied to the ink within the nozzle by increasing the expanding and contracting velocity of the piezoelectric element of the actuator and increasing the vibration of the actuator. The expansion and contraction velocity of the piezoelectric element can be increased by increasing the amount of voltage change during a leading edge period (or a trailing edge period) of a voltage pulse applied to a first electrode (the amount of voltage change is a value wherein the amount of voltage change is divided by the period concerned, and will be termed 'voltage change' below). However, if the voltage change of the voltage pulse is also increased in the case where printing is to be performed by discharging ink from the nozzle, the ink droplet is not stably discharged from the nozzle. There is a range of voltage change suitable for discharging the ink droplet stably from the nozzle. Consequently, it is preferred that there is not an increase in the voltage change that is applied when printing is to be performed. To deal with this, the present inventors developed a novel technique whereby non-discharge flushing can be performed effectively without having an adverse effect on printing.

An ink jet printer taught in the present specification includes a passage unit, an actuator and a pulse applying device. The passage unit includes a nozzle, a pressure chamber, and an ink passage located between the nozzle and the pressure chamber. The actuator faces the pressure chamber. The actuator includes a first electrode, a second electrode to which a reference potential is to be applied, and a piezoelectric element located between the first electrode and the second electrode. The pulse applying device is capable of applying a first voltage pulse and a second voltage pulse to the first electrode. The first voltage pulse is applied such that the nozzle discharges an ink droplet. The second voltage pulse is applied such that the nozzle does not discharge the ink droplet. A voltage change on a leading edge and/or a trailing edge of the second voltage pulse is greater than a voltage change on a leading edge and/or a trailing edge of the first voltage pulse.

The aforementioned 'voltage change on a leading edge and/or a trailing edge of the second voltage pulse that is greater than a voltage change on a leading edge and/or a trailing edge of the first voltage pulse' refers to any of the three patterns below:

(1) The voltage change on the leading edge of the second voltage pulse is greater than the voltage change on the leading edge of the first voltage pulse;

(2) The voltage change on the trailing edge of the second voltage pulse is greater than the voltage change on the trailing edge of the first voltage pulse; and (3) The voltage change on the leading edge of the second voltage pulse is greater than the voltage change on the leading edge of the first voltage pulse, with the voltage change on the trailing edge of the second voltage pulse also being greater than the voltage change on the trailing edge of the first voltage pulse.

With this ink jet printer, it is possible to adopt the first voltage pulse that maintains a voltage change that allows the ink droplet to be discharged stably. That is, the voltage change of the first voltage pulse is set to be a value in which the ink droplet can be discharged stably. Printing can consequently be performed by ink droplets that are discharged stably. The voltage change of the second voltage pulse is greater than the voltage change of the first voltage pulse. As a result, when non-discharge flushing is performed by means of the second voltage pulse, the expansion and contraction velocity of the piezoelectric element of the actuator can be made greater than the velocity used for printing. In this ink jet printer, it is possible to increase the energy applied by the actuator to the ink within the nozzle during non-discharge flushing. Non-discharge flushing can consequently be performed efficiently.

Furthermore, the aforementioned ink jet printer may perform only non-discharge flushing without performing the discharge flushing. However, the aforementioned technique does not exclude a device which is capable of performing both the discharge flushing and the non-discharge flushing.

DETAILED DESCRIPTION OF THE INVENTION

Figure 1:
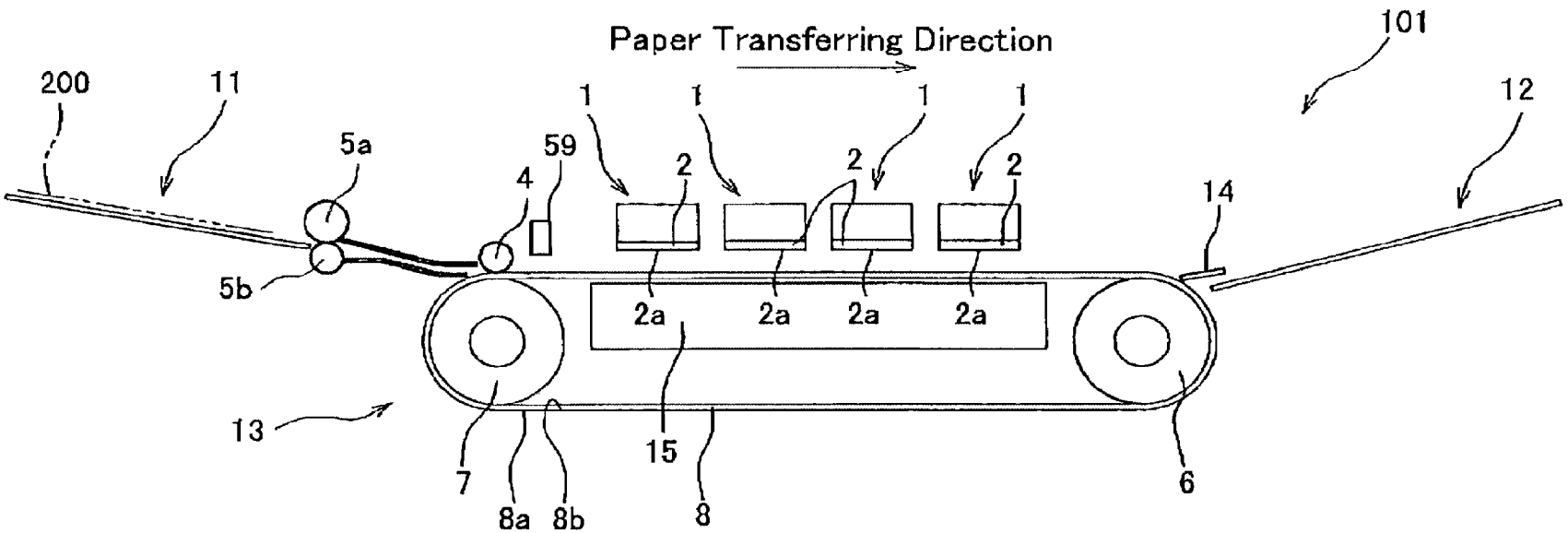
FIG. 1 shows an outline side view of the entire configuration of an ink jet printer.

A suitable embodiment of the present invention will be described below with reference to the figures. FIG. 1 shows an outline side view of the entire configuration of an ink jet printer 101 (hereafter referred to as printer 101). As shown in FIG. 1, the printer 101 is a color ink jet printer that has four ink jet heads 1. In this printer 101, a paper feeding part 11 is on the left, and a paper discharge part 12 is on the right.

A paper transferring path for transferring paper (a print medium) 200 from the paper feeding part 11 toward the paper discharge part 12 is formed within the printer 101. A pair of transfer rollers 5*a* and 5*b* is disposed at a downstream side, in the direction of paper transferring of the paper feeding part 11. The pair of transfer rollers 5*a* and 5*b* transfers the paper 200 from the paper feeding part 11 toward the right. A belt transferring mechanism (paper transferring mechanism) 13 is disposed in a central portion of the paper transferring path. The belt transferring mechanism 13 has two belt rollers 6 and 7, a transfer belt 8, and a platen 15. The transfer belt 8 is wound around the belt rollers 6 and 7. The transfer belt 8 is adjusted to have a length such that a predetermined tension is generated when it is wound around the belt rollers 6 and 7. The platen 15 is disposed within a region surrounded by the transfer belt 8. The platen 15 is disposed in a position facing the ink jet head 1. The platen 15 supports the transfer belt 8 so that the transfer belt 8 does not bend downward. A nip roller 4 is disposed in a position facing the belt roller 7. The nip roller 4 presses the paper 200 against an outer peripheral surface 8*a* of the transfer belt 8.

The belt roller 6 is rotated by a transfer motor (not shown). The transfer belt 8 is driven by the rotation of the belt roller 6. The transfer belt 8 thus supports the paper 200, and transfers it toward the paper discharge part 12.

A separating mechanism 14 is disposed at a downstream side, in the direction of paper transferring, of the transfer belt 8. The separating mechanism 14 separates the paper 200 from the outer peripheral plane 8*a* of the transfer belt 8. The paper 200 that has been separated from the transfer belt 8 by the separating mechanism 14 is delivered toward the paper discharge part 12.

The four ink jet heads 1 correspond to four colors of ink (magenta, yellow, cyan, and black). The four ink jet heads 1 are aligned along the transferring direction. That is, the ink jet printer 101 is a line type printer. A lower end of each of the ink jet heads 1 has a head main body 2. The head main bodies 2 are aligned in a rectangular parallelepiped shape that extends in a direction orthogonal to the transferring direction (perpendicular relative to the plane of the page of FIG. 1). An ink discharge face 2*a* is formed at a bottom face of each head main body 2. The ink discharge faces 2*a* face the outer peripheral plane 8*a*. The paper 200 passes in sequence below the four head main bodies 2. At this juncture, the ink is discharged from the ink discharge faces 2*a* toward an upper surface of the paper 200. The printer 101 thus forms a desired color image on the upper surface of the paper 200.

Furthermore, the printer 101 also comprises a paper detecting sensor 59. The paper detecting sensor 59 is disposed downstream from the nip roller 4. The paper detecting sensor 59 is capable of detecting whether paper is present.

Figure 2:
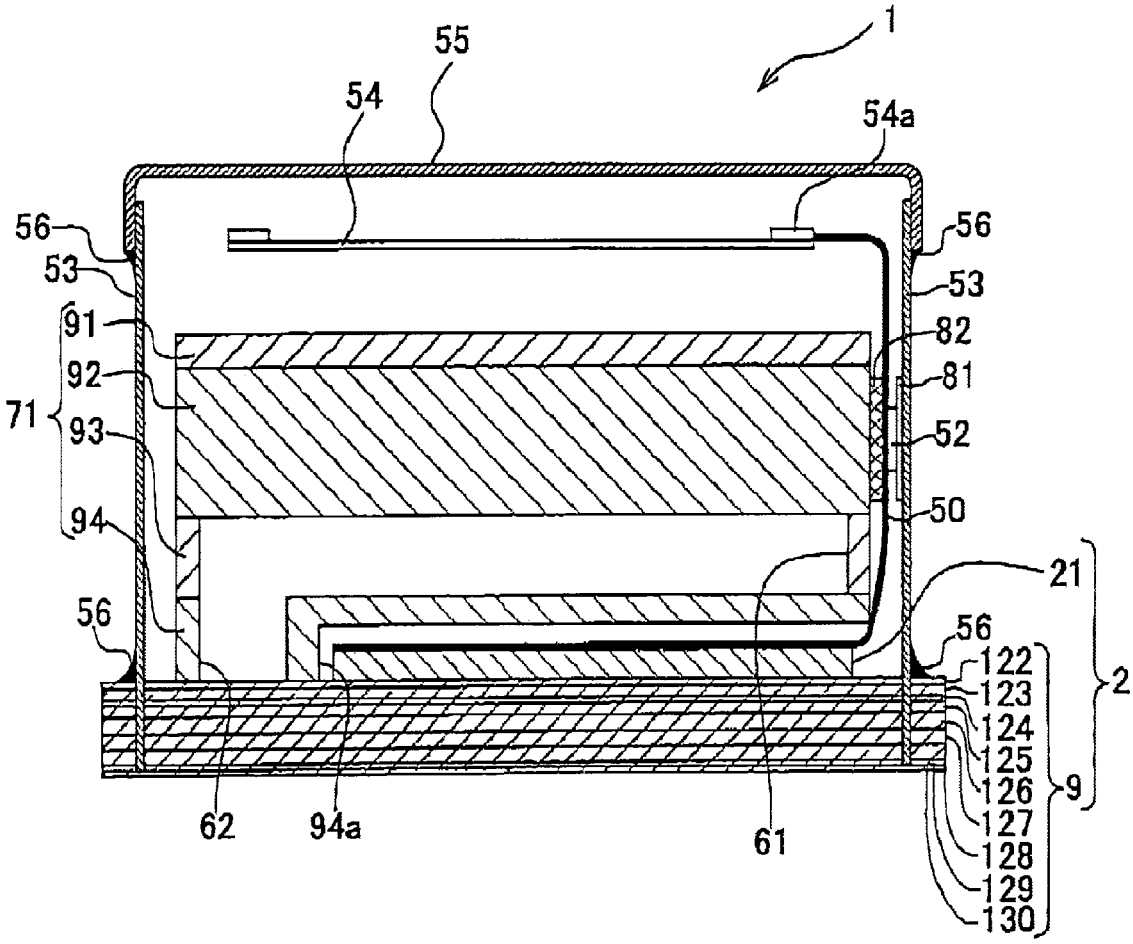
FIG. 2 shows a cross-sectional view of the ink jet head along a shorter direction thereof.

Next, the ink jet head 1 will be described in detail with reference to FIG. 2. FIG. 2 is a cross-sectional view of the ink jet head 1 along a shorter direction thereof. As shown in FIG. 2, the ink jet head 1 has a head main body 2, a reservoir unit 71, a COF (Chip On Film) 50, a substrate 54, a side cover 53, and a head cover 55.

The reservoir unit 71 is disposed on an upper surface of the head main body 2. The reservoir unit 71 is formed from four stacked plates 91 to 94. The reservoir unit 71 is formed from an ink inflow passage (not shown), an ink reservoir 61, and ten ink outflow passages 62. The ink inflow passage communicates with the ink reservoir 61. Each ink outflow passage 62 communicates with the ink reservoir 61. In FIG. 2, only one of the ink outflow passages 62 is shown. Ink flows from an ink tank (not shown) into the ink inflow passage. The ink reservoir 61 stores the ink temporarily. The ink outflow passages 62 communicate with a passage unit 9 via an ink supply opening 105*b* (see FIG. 3) formed in an upper surface of the passage unit 9. The ink flows from the ink tank to the ink reservoir 61 along the ink inflow passage. The ink that has flowed into the ink reservoir 61 passes through the ink outflow passages 62 and is supplied to the passage unit 9 of the head main body 2 via the ink supply opening 105*b*. A concave portion 94*a* is formed in the plate 94. A space is formed between the passage unit 9 and the part of the plate 94 in which the concave portion 94*a* is formed. An actuator unit 21 is disposed within this space.

One end portion of the COF 50 makes contact with an upper surface of the actuator unit 21. Wiring (not shown) is formed at a surface of the COF 50. This wiring is electrically connected with individual electrodes 135 and a common electrode 134 (to be described). The COF 50 extends upward from the upper surface of the actuator unit 21. The COF 50 passes between the side cover 53 (the right side cover 53 in FIG. 2) and the reservoir unit 71. A driver IC 52 is mounted on the COF 50. The driver IC 52 is disposed between the side cover 53 and the reservoir unit 71. The driver IC 52 generates driving signals for driving the actuator unit 21. A sponge 82 is bonded to a side surface of the reservoir unit 71. The driver IC 52 is pushed toward the right (toward the side cover 53) by the sponge 82. A radiating seat 81 is attached an inner side surface of the side cover 53. The driver IC 52 is thermally joined with the side cover 53 by being bonded to the radiating seat 81. Heat from the driver IC 52 is thus radiated to the exterior via the side cover 53.

The substrate 54 is electrically connected with the COF 50. The substrate 54, via the COF 50, commands the driver IC 52 to output driving signals to the actuator unit 21 based on commands from a host controller (not shown). The substrate 54 controls the driving of the actuator unit 21.

The side cover 53 extends upward from both end parts in the widthwise direction of the upper surface of the passage unit 9. Furthermore, a pair of side covers (not shown) also extends upward from both end parts in the lengthwise direction of the upper surface of the passage unit 9 (below, the four side covers will collectively be termed the side cover 53). The side cover 53 is a metal plate member. The head cover 55 is attached to an upper end of the side cover 53. The reservoir unit 71, the COF 50, and the substrate 54 are disposed within a space surrounded by the side cover 53 and the head cover 55. A sealing member 56 consisting of silicon resin material, or the like, is spread onto a connecting part of the side cover 53 and the passage unit 9, and onto a fitting part of the side cover 53 and the head cover 55. Ink or ink mist can thus effectively be prevented from entering into the space surrounded by the side cover 53 and the head cover 55 from the exterior.

Figure 3:
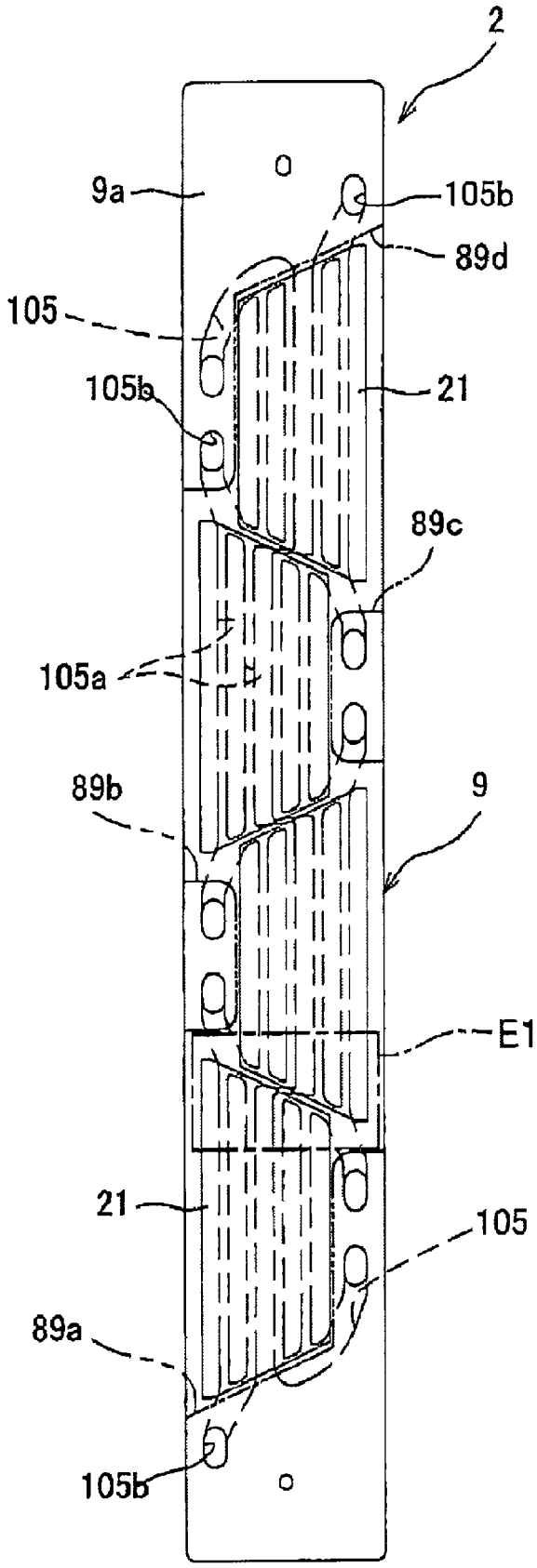
FIG. 3 shows a plan view of a head main body.
Figure 4:
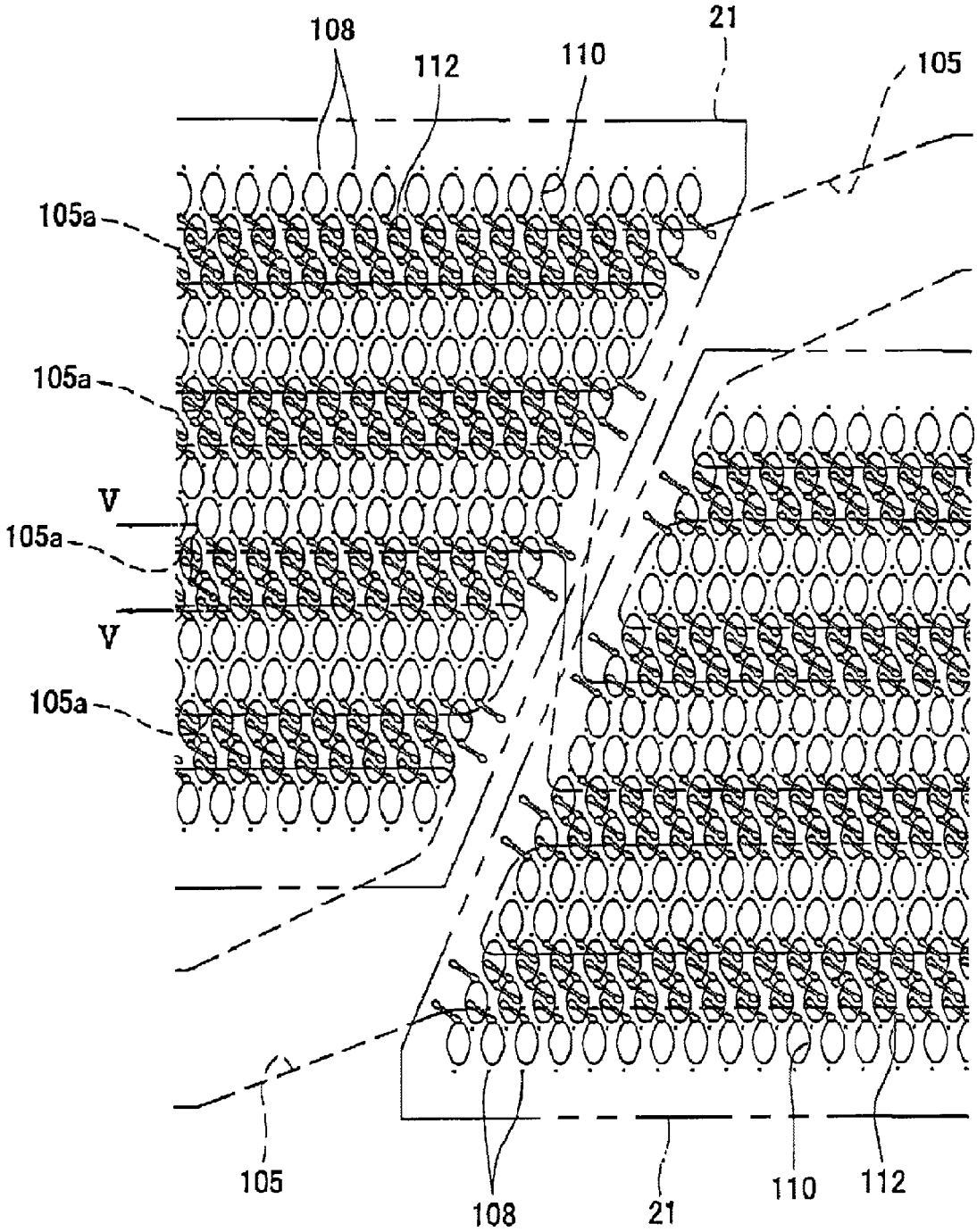
FIG. 4 shows an expanded view of a region E1 shown in FIG. 3.
Figure 5:
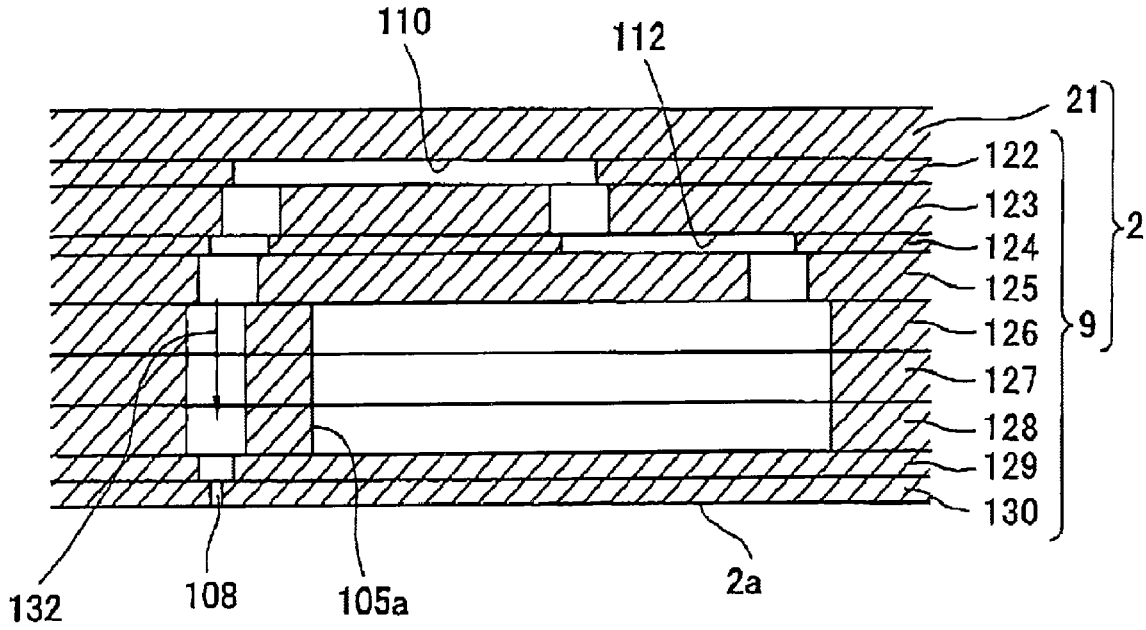
FIG. 5 shows a cross-sectional view along the line V-V shown in FIG. 4.
Figure 6A:
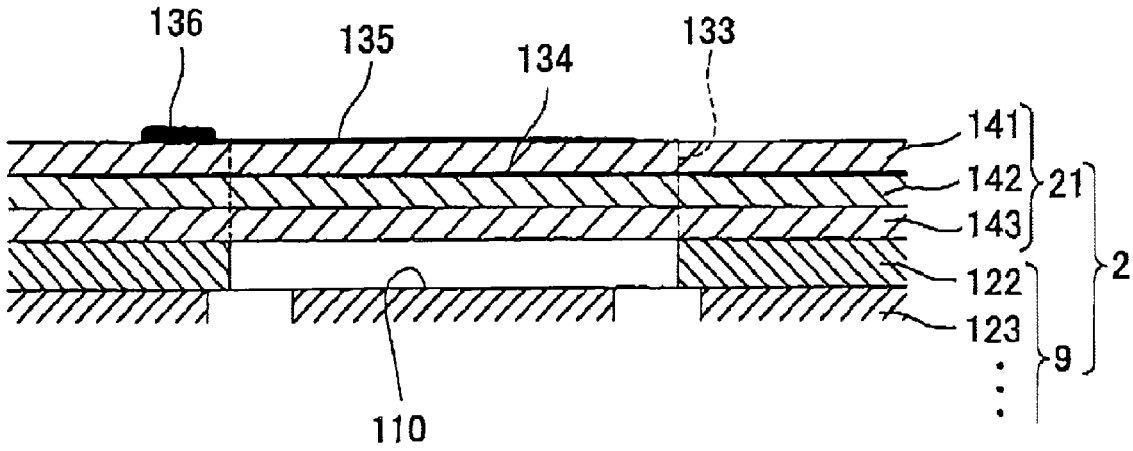
FIG. 6 shows expanded views of an actuator unit.
Figure 6B:
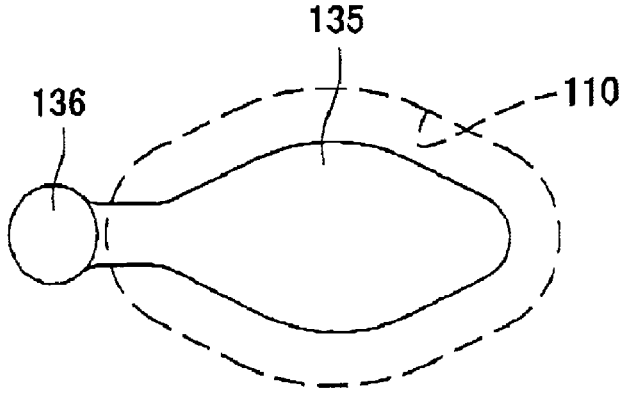

Next, the head main body 2 will be described with reference to FIGS. 3 to 6. FIG. 3 is a plan view of the head main body 2. FIG. 4 is an expanded view of a region E1 surrounded by the dashed line shown in FIG. 3. In FIG. 4, pressure chambers 110, apertures 112, and nozzles 108 are shown by solid lines although these are below the actuator unit 21 and should actually be shown by broken lines. FIG. 5 shows a cross-sectional view along the line V-V shown in FIG. 4. FIG. 6A is an expanded cross-sectional view of the actuator unit 21. FIG. 6B is a plan view of individual electrodes disposed on the surface of the actuator unit 21 in FIG. 6A.

As shown in FIG. 3, the head main body 2 contains the passage unit 9, and four actuator units 21. As shown in FIG. 4, the passage unit 9 contains a plurality of the pressure chambers 110, etc. The actuator units 21 are fixed to an upper surface 9*a* of the passage unit 9. As shown in FIG. 6A, each actuator unit 21 contains actuators 133 wherein each actuator 133 corresponds to different one pressure chamber 110. Each actuator 133 applies discharging energy to the ink within the corresponding pressure chamber 110.

The passage unit 9 has a rectangular parallelepiped shape that has a plane shape that is substantially the same as the plate 94 of the reservoir unit 71. As shown in FIG. 3, ten ink supply openings 105*b* open into the upper surface 9*a* of the passage unit 9. The ink supply openings 105*b* correspond to the ink outflow passages 62 (see FIG. 2) of the reservoir unit 71. As shown in FIGS. 3 and 4, manifold passages 105 that communicate with the ink supply openings 105*b*, and sub-manifold passages 105*a* that bifurcate from the manifold passages 105 are formed within the passage unit 9. As shown in FIGS. 4 and 5, the ink discharge faces 2*a* are formed in a lower surface of the passage unit 9. A plurality of the nozzles 108 is disposed in a matrix state in the ink discharge faces 2*a*. Like the nozzles 108, the pressure chambers 110 are disposed in a matrix state. Below, a plurality of pressure chambers 110 aligned equidistantly along the longer direction of the passage unit 9 will be termed a pressure chamber row. There are sixteen pressure chamber rows. The pressure chamber rows are mutually parallel in the shorter direction of the passage unit 9. The number of pressure chambers 110 included in one pressure chamber row corresponds to the external shape (trapezoid shape) of the actuator units 21 (to be described), and are disposed so as to gradually reduce in number from the longer edge side to the shorter edge side of the trapezoid shape. The nozzles 108 are disposed in the same manner.

As shown in FIG. 5, the passage unit 9 includes a cavity plate 122, a base plate 123, an aperture plate 124, a supply plate 125, manifold plates 126, 127, 128, a cover plate 129, and a nozzle plate 130. These plates 122 to 130 are metal plates formed from stainless steel or the like. The plates 122 to 130 have rectangular plan sheet shape that extends in a main scanning direction (the up-down direction in FIG. 3).

Ten first through holes are formed in the cavity plate 122. The first through holes function as ink supply openings 105*b* (see FIG. 3). Further, a plurality of substantially diamond shaped second through holes is formed in the cavity plate 122. The second through holes function as the pressure chambers 110. Two through holes for each pressure chamber 110 are formed in the base plate 123. One of these through holes functions as a communication hole between the pressure chamber 110 and the aperture 112. The other of these through holes functions as a communication hole between the pressure chamber 110 and the nozzle 108. Furthermore, another ten through holes are also formed in the base plate 123 and function as communication holes between the ink supply openings 105*b* and the manifold passages 105. Through holes are formed in the aperture plate 124 and function as the apertures 112. Through holes are formed in the aperture plate 124 and function as communication holes between the pressure chambers 110 and the nozzles 108. Furthermore, ten through holes are formed in the aperture plate 124 and function as communication holes (not shown) between the ink supply openings 105*b* and the manifold passages 105. Through holes are formed in the supply plate 125 and function as communication holes between the apertures 112 and the sub-manifold passages 105*a*. Through holes are formed in the supply plate 125 and function as communication holes between the pressure chambers 110 and the nozzles 108. In addition, ten through holes are formed in the supply plate 125 and function as communication holes (not shown) between the ink supply openings 105*b* and the manifold passages 105.

A plurality of through holes is formed in the manifold plates 126, 127, 128 and function as communication holes between the pressure chambers 110 and the nozzles 108. Furthermore, through holes are formed in the manifold plates 126, 127, 128 and function as the manifold passages 105 and the sub-manifold passages 105*a*. Through holes are formed in the cover plate 129 and function as communication holes between the pressure chambers 110 and the nozzles 108. A plurality of through holes is formed in the nozzle plate 130 and function as the nozzles 108. A plurality of individual ink passages 132 is formed in the passage unit 9 by stacking the plates 122 to 130.

Next, the flow of ink within the passage unit 9 will be described. The ink is fed from the reservoir unit 71 to the interior of the passage unit 9 via the ink supply openings 105*b*. As shown in FIGS. 3 to 5, the ink that has been fed to the interior of the passage unit 9 flows from the manifold passages 105 into the sub-manifold passages 105*a*. The ink within the sub-manifold passages 105*a* reaches the nozzles 108 via the apertures 112 and the pressure chambers 110.

The actuator units 21 will now be described. As shown in FIG. 3, the actuator units 21 each have a trapezoid shape when viewed from in plan view. The four actuator units 21 are disposed in zigzag alignment so as to not interfere with the ink supply openings 105*b*. The long edges and the short edges of the actuator units 21 are parallel to the lengthwise direction of the passage unit 9. Two adjoining actuator units 21 overlap in the widthwise direction of the passage unit 9 (in the left-right direction of FIG. 3).

As shown in FIG. 6A, the actuator unit 21 has three piezoelectric sheets 141 to 143. The piezoelectric sheets 141 to 143 are fixed to an upper surface of the cavity plate 122. The piezoelectric sheets 141 to 143 are formed from a ferroelectric lead zirconate titanate (PZT) ceramic material. The individual electrodes 135 are formed on an upper surface of the uppermost piezoelectric sheet 141. The individual electrodes 135 are formed in positions facing the pressure chambers 110. As shown in FIG. 6B, the individual electrodes 135 are substantially diamond shaped similar to the pressure chambers 110. In the plan view, the major part of the individual electrodes 135 overlaps with the pressure chambers 110. One of the acutely angled sections of the individual electrode 135 extends past the pressure chamber 110. A circular land 136 is connected with an anterior tip of the acutely angled section. The lands 136 and the individual electrodes 135 are electrically connected. The common electrode 134 (ground electrode) is disposed between the piezoelectric sheet 141 and the piezoelectric sheet 142. The common electrode 134 is disposed across the entire plane of the piezoelectric sheets 141 and 142. One actuator 133 is present for each pressure chamber 110. That is, the actuator units 21 have a plurality of actuators 133. Each actuator 133 has one individual electrode 135, the piezoelectric sheets 141, 142, 143, and the common electrode 134.

Ground potential (reference potential) is applied to the common electrode 134. The individual electrodes 135 are electrically connected to a terminal of the driver IC 52 via the lands 136 and internal wiring of the COF 50. Driving signals from the driver IC 52 are selectively input to the individual electrodes 135.

The piezoelectric sheet 141 is polarized in the direction of thickness by the common electrode 134 and the individual electrodes 135. When voltage is applied to the individual electrode 135 and the individual electrode 135 has a different potential from the common electrode 134, an electric field is applied to the piezoelectric sheet 141 in the direction of polarization (direction of thickness). The part of the piezoelectric sheet 141 to which the electric field has been applied functions as an active part that deforms due to piezoelectric effects. For example, if the direction of polarization and the direction in which the electric field is applied are the same, the active part contracts in a direction (the planar direction) orthogonal to the direction of polarization. That is, the actuator unit 21 is a unimorph type in which the piezoelectric sheet 141 becomes an active layer that has separated from the pressure chamber 110, and the piezoelectric sheets 142 and 143 close to the pressure chamber 110 are non-active layers. There is a difference between the amount that the active layer (the piezoelectric sheet 141) contracts and the amount that the non-active layers (the piezoelectric sheets 142 and 143) contract. As a result, all of the piezoelectric sheets 141 to 143 collectively deform (unimorph deformation) so as to protrude toward the pressure chamber 110. Pressure (discharging energy) is thus applied to the ink within the pressure chamber 110, and an ink droplet is discharged from the nozzle 108.

In the present embodiment, a predetermined potential is applied in advance to the individual electrode 135. After the individual electrode 135 obtains a ground potential via the driver IC 52 based on a command from the substrate 54, the driver IC 52 outputs a driving signal whereby the aforementioned predetermined potential is applied again at a predetermined timing to the individual electrode 135. In this case, the piezoelectric sheets 141 to 143 return to their original state with the same timing as when the individual electrode 135 changes from the predetermined potential to the ground potential, and the volume of the pressure chamber 110 is increased with respect to its preliminary state (the state in which voltage was applied in advance). When the volume of the pressure chamber 110 increases, ink is sucked from the sub-manifold passage 105*a* into the individual ink passage 132. Then when the predetermined potential is again applied to the individual electrode 135, the piezoelectric sheets 141 to 143 deform so as to protrude toward the pressure chamber 110. The volume in the pressure chamber 110 thus decreases, the pressure of the ink is increased, and the ink is discharged from the nozzle 108.

Ink droplets that have adhered to the paper 200 dry rapidly when quick-drying ink is utilized. The discharging interval for the ink droplets can consequently be made shorter, and rapid printing becomes possible. However, when quick-drying ink is utilized, the ink readily dries within the nozzles 108 and becomes viscous. When the ink within the nozzles 108 is viscous, the ink discharge characteristics may deteriorate, and unsatisfactory discharging may occur. To deal with this, the ink jet printer 101 selectively performs normal printing in which ink droplets are discharged from the nozzles 108, and non-discharge flushing in which the ink within the nozzles 108 is agitated by causing the vibration of the ink meniscus formed within openings of the nozzles 108.

Specifically, the substrate 54 determines, based on the results detected by the paper detecting sensor 59 (see FIG. 7), whether the paper 200 is facing the ink discharge faces 2*a*. The paper detecting sensor 59 detects both edges of the paper 200. The timing of the discharge of the ink droplets from the ink jet heads 1 is based on the detection signals of the paper detecting sensor 59. That is, the printing is performed while the paper 200 is facing the ink discharge faces 2*a* of the ink jet heads 1. Furthermore, the non-discharge flushing is performed while the paper 200 is not facing the ink discharge faces 2*a*.

Figure 7:
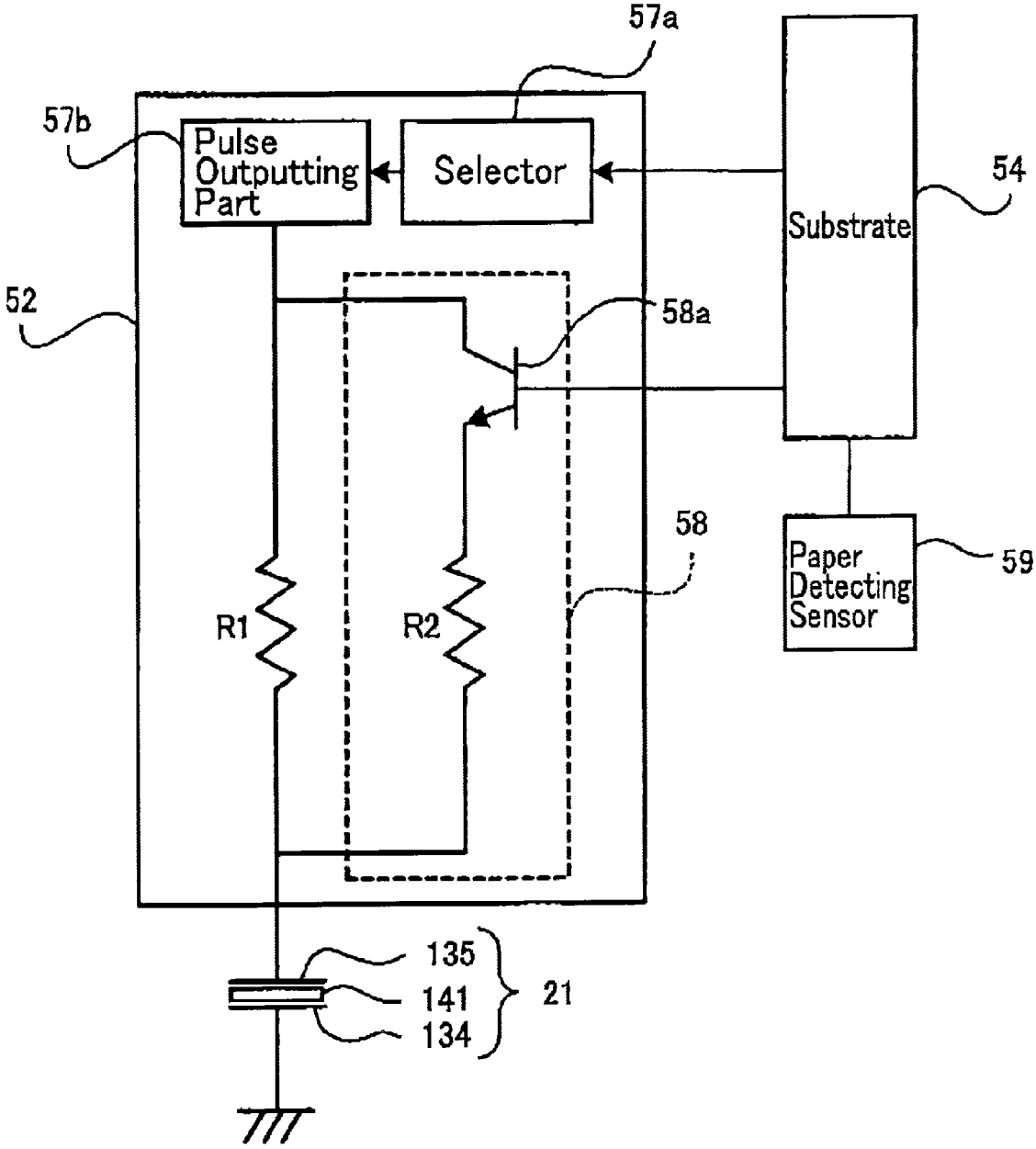
FIG. 7 shows a partial outline view of the internal configuration of a driver IC.

Next, the driver IC 52 will be described in detail with reference to FIG. 7. FIG. 7 shows a partial outline view of the internal configuration of the driver IC 52. FIG. 7 schematically shows only a configuration (termed driving configuration below) for outputting driving signals to one individual electrode 135 that corresponds to one nozzle 108. The driver IC 52 has a plurality of driving configurations that is identical in number to the number of individual electrodes contained in one actuator unit 21. The driver IC 52 includes a selector 57*a*, a pulse outputting part 57*b*, and a pulse adjusting circuit 58. Based on commands from the substrate 54, the selector 57*a* selects either a discharge waveform or a non-discharge flushing waveform. The discharge waveform is a voltage pulse (a first voltage pulse) for driving the actuator unit 21 such that an ink droplet is discharged from the nozzle 108. There are a number of discharge waveform patterns that correspond to the various types of ink droplets to be discharged from the nozzle 108. The non-discharge flushing waveform is a voltage pulse (a second voltage pulse) for driving the actuator unit 21 such that an ink droplet is not discharged from the nozzle 108. In the case where the command to perform printing has come from the substrate 54, the selector 57*a* selects one of the different types of discharge waveforms, and in the case where the command to perform non-discharge flushing has come from the substrate 54, the selector 57*a* selects the non-discharge flushing waveform. The pulse outputting part 57*b* generates a driving signal that has the waveform selected by the selector 57*a*, and outputs this driving signal to the individual electrode 135. The driving signal output from the pulse outputting part 57*b* is output to the individual electrode 135 via a resistor R1. The resistor R1 determines a current value of the driving signal.

The pulse adjusting circuit 58 includes a resistor R2 and a switch 58*a*. Based on commands from the substrate 54, the pulse adjusting circuit 58 adjusts the length of the leading time and the trailing time included in the driving signals output from the pulse outputting part 57*b*. In a case where the switch 58*a* is closed, the resistor R1 is connected in parallel with the resistor R2. Specifically, in the case where there was a command from the substrate 54 to perform normal printing, the pulse adjusting circuit 58 opens (turns OFF) the switch 58*a*. At this juncture, a driving signal having the discharge waveform is applied from the pulse outputting part 57*b* to the individual electrode 135 via only the resistor R1. In the case where there was a command from the substrate 54 to perform non-discharge flushing, the pulse adjusting circuit 58 closes (turns ON) the switch 58*a*. In this case, a driving signal having the non-discharge flushing waveform is applied from the pulse outputting part 57*b* to the individual electrode 135 via the resistor R1 and the resistor R2 that are connected in parallel. That is, in a case where the driving signal with the non-discharge flushing waveform is output (in the case where the switch 58*a* is closed), the resistance between the individual electrode 135 and an output terminal of the pulse outputting part 57*b* is smaller than the resistance when a driving signal with the discharge waveform is output (in the case where the switch 58*a* is open). It is possible in the present embodiment, by opening and closing the switch 58*a*, to switch between a first circuit that includes only the resistor R1, and a second circuit in which the resistor R1 and the resistor R2 are connected in parallel.

Figure 8A:
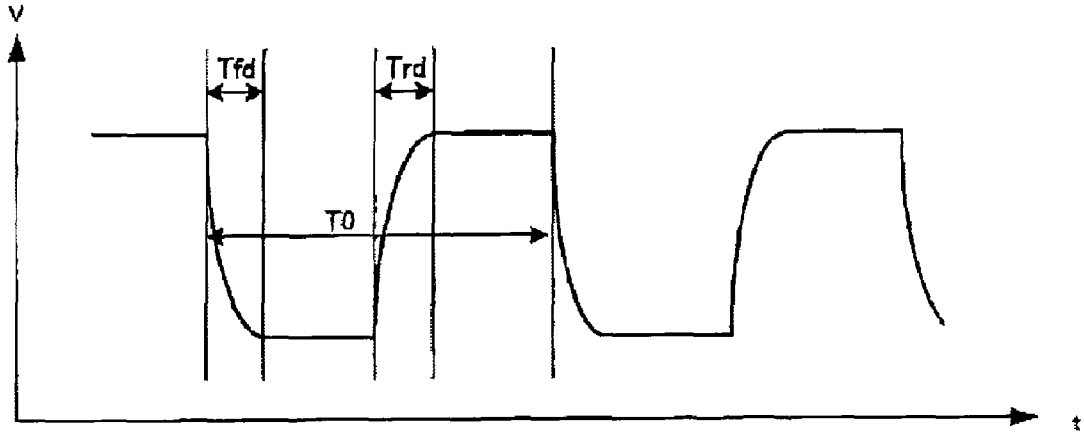
FIG. 8 shows waveforms output from the driver IC.
Figure 8B:
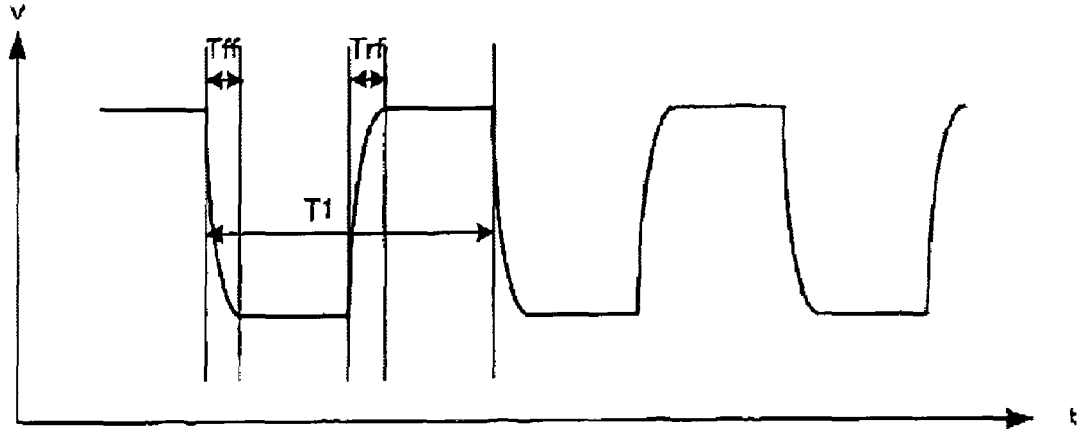

Waveforms of the driving signals output from the driver IC 52 will be described with reference to FIG. 8. FIG. 8 shows the waveforms of the driving signals output from the driver IC 52. FIG. 8A shows an example of a discharge waveform. FIG. 5B shows an example of a non-discharge flushing waveform. As shown in FIG. 8A, the number of pulses, which are continuous, in the discharge waveform is the same as the number of ink droplets to be discharged (for example, 1 to 3 droplets in the present embodiment). As shown in FIG. 8B, a predetermined number of pulses are continuous in the non-discharge flushing waveform. A pulse width in the non-discharge flushing waveform is shorter than a pulse width in the discharge waveform. The period T1 of the non-discharge flushing waveform is shorter than the period T0 of the discharge waveform. The pulse width in the non-discharge flushing waveform is determined to be in a range in which an ink droplet is not discharged from the nozzle 108. Specifically, in a case where a pressure reducing period (period from a trailing to a leading of one pulse) is AL in order to realize the maximum discharging speed of the ink discharged from the nozzle, the pressure reducing period of the non-discharge flushing is set at a value less than or equal to ⅔ of AL. In addition, the pressure reducing period of the non-discharge flushing may be set to be within a range of between $(2s-\frac{1}{2})\times AL$ and $(2s+\frac{2}{3})\times AL$ (s is a positive integer). The pressure reducing period is the period from when the pressure in the pressure chamber is being reduced until when the pressure therein begins increasing. Furthermore, the amplitude of the voltage pulse of the discharge waveform is the same as the amplitude of the voltage pulse of the non-discharge flushing waveform. Additionally, the utilization of pulse shape in non-discharge flushing is set forth in detail in US Patent Application Publication NO. 2006-0284908, the contents of which are hereby incorporated by reference into the present application.

The length of the leading time and the length of the trailing time of the voltage pulse applied to the individual electrode 135 is determined by a time constant calculated from the resistance and capacitance between the output terminal of the pulse outputting part 57*b* and the individual electrode 135, and from the capacitance of the actuator unit 21 (determined from the configuration of the common electrode 134, the individual electrode 135, and the piezoelectric sheet 141 held between these two). In the present embodiment, the capacitance between the output terminal of the pulse outputting part 57*b* and the individual electrode 135, and the capacitance of the actuator unit 21 are fixed. As a result, the length of the leading time and the length of the trailing time of the voltage pulse are adjusted only by the resistance between the output terminal of the pulse outputting part 57*b* and the individual electrode 135. That is, the length of both the leading time and the trailing time of the voltage pulse decreases when the resistance becomes smaller between the output terminal of the pulse outputting part 57*b* and the individual electrode 135. The amplitude does not change even if the resistance changes. As a result, when the length both of the leading time and the trailing time of the voltage pulse decreases, there is an increase in the absolute value of the amount of voltage change (the voltage change) with respect to the leading time and the trailing time of the voltage pulse applied to the individual electrode 135. The greater the voltage change of the voltage pulse, the faster the deformation speed of the actuator unit 21.

As described above, in the case where the driving signal with the discharge waveform is output, the resistance between the output terminal of the pulse outputting part 57*b* and the individual electrode 135 is set such that the voltage change of the voltage pulse of the discharge waveform is a voltage change that allows the ink droplets to be stably discharged from the nozzle 108. As a result, printing can be performed by means of ink droplets that are discharged stably. In the case where the driving signal with the non-discharge flushing waveform is output, the resistance between the output terminal of the pulse outputting part 57*b* and the individual electrode 135 is set so it is smaller than the resistance when the driving signal with the discharge waveform is output. As a result, the voltage change of the voltage pulse of the non-discharge flushing waveform is greater than the voltage change of the voltage pulse of the discharge waveform. That is, the leading time Trf of the non-discharge flushing waveform is shorter than the leading time Trd of the discharge waveform, and the trailing time Tff of the non-discharge flushing waveform is shorter than the trailing time Tfd of the discharge waveform. The expansion and contraction speed of the actuator unit 21 is greater in the case where the driving signal with the non-discharge flushing waveform is output than in the case where the driving signal with the discharge waveform is output. When the expanding and contracting speed of the actuator unit 21 is greater, the pressure wave generated within the individual ink passage 132 has greater amplitude. The non-discharge flushing of the ink within the individual ink passage 132 can thus be performed effectively.

In the present embodiment, the resistance of the resistor R2 is adjusted such that the leading time Trf and the trailing time Tff of the non-discharge flushing waveform is 1/n times the period of the characteristic vibration of the actuator unit 21 (n is a positive integer). The actuator is capable of vibrating in synchrony with the leading time and trailing time of the voltage pulse of the non-discharge flushing waveform. The vibration amplitude of the actuator can also be increased. Non-discharge flushing can consequently be performed more efficiently.

In the present embodiment, the voltage change of the voltage pulse of the non-discharge flushing waveform is made greater than the voltage change of the voltage pulse of the discharge waveform by changing the resistance between the individual electrode 135 and the output terminal of the pulse outputting part 57*b*. As a result, it is possible to realize the pulse adjusting circuit 58 using a simple configuration that does not utilize a condenser or the like between the individual electrode 135 and the output terminal of the pulse outputting part 57*b*. Furthermore, the resistance between the individual electrode 135 and the output terminal of the pulse outputting part 57*b* is changed by switching the switch 58*a*. It is not necessary to use a changeable resistor, etc. in order to change the resistance between the individual electrode 135 and the output terminal of the pulse outputting part 57*b*.

In the present embodiment, the driver IC 52 can alter the voltage change of the voltage pulse by altering the configuration of the first circuit and the second circuit. Consequently the driver IC 52 needs to comprise only one pulse outputting part 57*b*. The configuration of the ink jet printer 101 can thus be simplified.

Furthermore, in the present embodiment, the non-discharge flushing waveform is set to be within a range wherein an ink droplet is not discharged from the nozzle 108. As a result, it is possible to reliably prevent an ink droplet from being discharged from the nozzle 108 while the non-discharge flushing is being performed.

In addition, in the present embodiment, the amplitude of the discharge waveform is the same as the amplitude of the non-discharge flushing waveform. A step-up circuit or step-down circuit is consequently not necessary, and it is possible to realize a pulse outputting part 57*b* with a simple configuration.

Furthermore, in the present embodiment; the pulse outputting part 57*b* performs the non-discharge flushing only when the paper 200 being transferred by the transfer belt 8 is not facing the nozzle 108. The paper 200 is consequently not stained even if an ink droplet is accidentally discharged from the nozzle 108 during non-discharge flushing.

A suitable embodiment of the present invention has been described above, but the present invention is not limited to the specific example described above, and the art set forth in the claims encompasses various transformations and modifications to the embodiment described above. For example, in the embodiment described above, the pulse adjusting circuit 58 changes the voltage change of the non-discharge flushing waveform both during the leading time and the trailing time. However, the voltage change of the non-discharge flushing waveform may be changed only during either the leading time or the trailing time.

In the embodiment described above, the leading time Trf and the trailing time Tff of the non-discharge flushing waveform is configured to be 1/n times the period of the characteristic vibration of the actuator unit 21. However, at least one of the leading time and the trailing time of the non-discharge flushing waveform may be configured to not be 1/n times the period of the characteristic vibration of the actuator unit 21.

Furthermore, in the embodiment described above, the pulse adjusting circuit 58 is in a configuration in which adjusting the voltage change of the voltage pulse is achieved by changing the resistance between the individual electrode 135 and the output terminal of the pulse outputting part 57*b*. However, the pulse adjusting circuit is not limited to this configuration. For example, in the pulse adjusting circuit, a resistor and a coil may be connected in series between the output terminal of the pulse outputting part 57*b* and the individual electrode 135. In this case, a switch is disposed between the resistor and the coil. In the case where the pulse outputting part 57*b* outputs the discharge waveform, the resistor and the coil are connected in series (a first circuit). The discharge waveform is applied to the individual electrode 135 via the resistor and the coil. In the case where the pulse outputting part 57*b* outputs the non-discharge flushing waveform, the switch is switched, and only the resistor is utilized (a second circuit). The non-discharge flushing waveform is applied to the individual electrode 135 via only the resistor. The voltage change of the voltage pulse of the non-discharge flushing waveform can be increased by this means also. Furthermore, for example, in the pulse adjusting circuit, a resistor may be connected between the output terminal of the pulse outputting part 57*b* and the individual electrode 135, and a condenser, connected in parallel with the actuator unit 21, may be disposed at a lower side of the resistor. In this case, a switch is disposed between the resistor and the condenser. A ground potential (reference potential) is applied at the side of the condenser that opposite to the resistor. In the case where the pulse outputting part 57*b* outputs the discharge waveform, the condenser and the actuator unit 21 are connected in parallel (a first circuit). The discharge waveform is applied to the individual electrode 135 and the condenser via the resistor. In the case where the pulse outputting part 57*b* outputs the non-discharge flushing waveform, the switch is switched, and only the resistor is utilized (a second circuit). That is, the non-discharge flushing waveform is not applied to the condenser. The non-discharge flushing waveform is applied to the individual electrode 135 via only the resistor. The voltage change of the voltage pulse of the non-discharge flushing waveform can be increased by this means also.

In the embodiment described above, the pulse outputting part 57*b* has a configuration wherein it outputs driving signals in which the pulse width of the non-discharge flushing waveform is shorter than the pulse width of the discharge waveform. However, the pulse width of the non-discharge flushing waveform may be differed as necessary.

Furthermore, in the embodiment described above, the amplitude of the discharge waveform is the same as the amplitude of the non-discharge flushing waveform. However, the amplitude of the waveforms may mutually differ.

Furthermore, in the embodiment described above, the pulse outputting part 57*b* is configured so as to perform the non-discharge flushing only when the paper 200 being transferred by the transfer belt 8 is not facing the nozzle 108. However, the pulse outputting part 57*b* may be configured so as to perform the non-discharge flushing of the nozzle 108, as it is a process that does not discharge ink droplets, while the paper 200 is facing the ink discharge faces 2*a*. This configuration is effective in cases where roll paper is being utilized. In this situation, the non-discharge flushing is performed based not on a signal from the paper detecting sensor 59, but on an output signal from a detecting means that detects the cut lines of the image data, or a measuring means that measures usage time and printing time.

What is claimed is:

1. An ink jet printer, comprising:

a passage unit comprising a nozzle, a pressure chamber, and an ink passage located between the nozzle and the pressure chamber;

an actuator facing the pressure chamber, the actuator comprising a first electrode, a second electrode to which a reference potential can be applied, and a piezoelectric element located between the first electrode and the second electrode; and a pulse controller which applies a first voltage pulse to the first electrode such that the nozzle discharges an ink droplet, and a second voltage pulse to the first electrode such that the nozzle does not discharge the ink droplet, wherein a voltage change on a leading edge and/or a trailing edge of the second voltage pulse is greater than a voltage change on a leading edge and/or a trailing edge of the first voltage pulse;

wherein the pulse controller comprises a voltage pulse outputting device, a first circuit located between the voltage pulse outputting device and the first electrode, and a second circuit located between the voltage pulse outputting device and the first electrode;

wherein, when the pulse controller applies the first voltage pulse to the first electrode, a voltage pulse output by the voltage pulse outputting device is applied to the first electrode via the first circuit;

wherein, when the pulse controller applies the second voltage pulse to the first electrode, the voltage pulse output by the voltage pulse outputting device is applied to the first electrode via the second circuit; and wherein the first circuit comprises a first resistor, and the second circuit comprises the first resistor and a second resistor connected in parallel with the first resistor.

2. The ink jet printer as in claim 1, wherein the pulse controller applies the second voltage pulse such that a leading time and/or a trailing time of the second voltage pulse is 1/n times a period of a characteristic vibration of the actuator, and n is a positive integer.

3. The ink jet printer as in claim 1, wherein a resistance of the first circuit is greater than a resistance of the second circuit.

4. The ink jet printer as in claim 1, wherein an amplitude of the first voltage pulse is the same as an amplitude of the second voltage pulse.

5. The ink jet printer as in claim 1, further comprising:

a transferring device transferring a print medium; and a detecting device detecting that the print medium transferred by the transferring device is facing the nozzle, wherein the pulse controller applies the second voltage pulse to the first electrode when the print medium is not facing the nozzle.

6. An ink jet printer, comprising:

a passage unit comprising a nozzle, a pressure chamber, and an ink passage located between the nozzle and the pressure chamber;

an actuator facing the pressure chamber, the actuator comprising a first electrode, a second electrode to which a reference potential can be applied, and a piezoelectric element located between the first electrode and the second electrode; and a pulse controller which applies a first voltage pulse to the first electrode such that the nozzle discharges an ink droplet, and a second voltage pulse to the first electrode such that the nozzle does not discharge the ink droplet, wherein a voltage change on a leading edge of the second voltage pulse is greater than a voltage change on a leading edge of the first voltage pulse.

* * * * *